US008992175B2

(12) United States Patent
Heli et al.

(10) Patent No.: US 8,992,175 B2
(45) Date of Patent: Mar. 31, 2015

(54) COMPACT FAN

(75) Inventors: Thomas Heli, Langenburg (DE); Jürgen Schöne, Bad Mergentheim (DE); Christian Haag, Mulfingen-Ailringen (DE); Alfred Korwin, Neunstein (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 648 days.

(21) Appl. No.: 12/918,405

(22) PCT Filed: Jan. 30, 2009

(86) PCT No.: PCT/EP2009/051069

§ 371 (c)(1),
(2), (4) Date: Aug. 19, 2010

(87) PCT Pub. No.: WO2009/103606

PCT Pub. Date: Aug. 27, 2009

(65) Prior Publication Data

US 2010/0329857 A1 Dec. 30, 2010

(30) Foreign Application Priority Data

Feb. 19, 2008 (DE) ..... 20 2008 002 356 U

(51) Int. Cl.
*F04D 23/00* (2006.01)
*F04D 29/02* (2006.01)
(Continued)

(52) U.S. Cl.
CPC ..... *F04D 29/023* (2013.01); *F04D 25/0613* (2013.01); *F04D 29/624* (2013.01); *F04D 29/703* (2013.01)
USPC ..... 415/209.3; 415/211.1; 415/213.1; 415/121.2

(58) Field of Classification Search
USPC ..... 415/121.1, 182.1, 185, 186, 189, 200, 415/208.2, 208.3, 209.2, 209.3, 211.1, 415/213.1, 915, 121.2
See application file for complete search history.

(56) References Cited

U.S. PATENT DOCUMENTS 2,439,124 A * 4/1948 Bergstrom ..... 415/211.1
2,805,615 A * 9/1957 Emil ..... 454/350
(Continued)

FOREIGN PATENT DOCUMENTS

DE 23 54 126 A1 10/1973
DE 298 21 861 U1 4/1999
(Continued)

OTHER PUBLICATIONS

PCT/EP2009/051069—International Search Report—May 8, 2009.

*Primary Examiner* — Dwayne J White
*Assistant Examiner* — Justin Seabe
(74) *Attorney, Agent, or Firm* — Brinks Gilson & Lione

(57) ABSTRACT

The present invention relates to a compact fan, comprising a fan wheel, in particular a radial fan wheel (1), which is fastened on a rotor of an external rotor motor (82). The fan wheel (1) is supported between a front plate (8) having an air inlet opening (9), which is central, and a motor mount (11). The front plate (8) and the motor mount (11) are connected to one another via multiple spacers (12), which are disposed around the circumference. The front plate (8) and the motor mount (11) are formed as plastic or metal spray parts. The spacers (12) are formed as plastic or metal parts entirely or partially in one piece to the front plate (8) and/or the motor mount (11).

17 Claims, 8 Drawing Sheets

(51) Int. Cl.

| | |
|---|---|
| ***F04D 25/06*** | (2006.01) |
| ***F04D 29/62*** | (2006.01) |
| ***F04D 29/70*** | (2006.01) |

(56) References Cited

U.S. PATENT DOCUMENTS

| | | | | |
|---|---|---|---|---|
| 2,987,983 | A * | 6/1961 | Solzman | 454/346 |
| 3,449,605 | A * | 6/1969 | Wilson | 310/58 |
| 3,574,480 | A * | 4/1971 | Hoepfner | 415/211.1 |
| 5,407,324 | A | 4/1995 | Starnes, Jr. et al. | |
| 5,788,566 | A * | 8/1998 | McAnally et al. | 454/184 |
| 6,000,919 | A | 12/1999 | Hsieh | |
| 6,406,258 | B1 | 6/2002 | Lin et al. | |
| 6,503,055 | B1 * | 1/2003 | Gerenski et al. | 415/208.1 |
| 6,540,476 | B2 * | 4/2003 | Huang et al. | 415/98 |
| 6,817,832 | B2 * | 11/2004 | Kim et al. | 415/204 |
| 6,827,549 | B1 * | 12/2004 | Horng et al. | 415/68 |
| 6,995,979 | B2 * | 2/2006 | Hsieh et al. | 361/695 |
| 7,011,504 | B2 * | 3/2006 | Seo et al. | 416/247 R |
| 7,140,837 | B2 * | 11/2006 | Ku et al. | 415/121.2 |
| 7,255,532 | B2 * | 8/2007 | Zheng | 415/183 |
| 2002/0004008 | A1 * | 1/2002 | Miyata | 415/206 |
| 2003/0202879 | A1 | 10/2003 | Huang | |
| 2005/0042088 | A1 | 2/2005 | Horski | |
| 2005/0089402 | A1 | 4/2005 | Horng | |
| 2005/0095126 | A1 | 5/2005 | Chang | |
| 2007/0128022 | A1 | 6/2007 | Yeh | |
| 2007/0212219 | A1 | 9/2007 | Teshima | |
| 2007/0253806 | A1 * | 11/2007 | Russell | 415/15 |

FOREIGN PATENT DOCUMENTS

| | | | |
|---|---|---|---|
| DE | 200 14 189 | U1 | 5/2001 |
| DE | 2005 004 092 | U1 | 5/2005 |
| DE | 20 2006 002 789 | U1 | 4/2006 |

* cited by examiner

COMPACT FAN

CROSS REFERENCE TO RELATED APPLICATION

This application claims priority to PCT/EP2009/051069 filed Jan. 30, 2009 and DE 20 2008 002 356.4 filed Feb. 19, 2008.

FIELD OF THE INVENTION

The present invention relates to a compact fan of a type having a centrifugal impeller fixed to a rotor of an external rotor motor.

BACKGROUND OF THE INVENTION

A compact fan of the above general type is disclosed by DE-G 90 17 873.4, for example.

Proceeding from such a compact fan, the object of the present invention is to achieve a compact construction that is technically easy to assemble, having improved flow characteristics.

According to the invention the front plate and the motor mount of the fan are formed as injection molded plastic or metal parts and the spacers, as injection molded plastic or metal parts, are wholly or in part integrally connected to the front plate and/or the motor mount. It is advantageous here if the front plate, the motor mount and the spacers form one integral injection molded part. It may also be advantageous if the front plate, the motor mount and the spacers are formed from two injection molded plastic or metal parts that can be connected together in the area of the spacers.

According to the invention, a simple construction that is technically easy to manufacture is therefore created, since the housing formed from the front plate and the motor mount is either integrally formed or may consist of just two separate parts. Moreover, all major functions can be incorporated into the housing. Advantageous embodiments of the invention will be explained in more detail on the basis of the exemplary embodiments represented in the drawings attached.

BRIEF DESCRIPTION OF THE DRAWINGS

In the figures below the same parts are in each case identified by the same reference numerals.

DETAILED DESCRIPTION OF THE INVENTION

A compact fan according to the invention comprises a fan impeller, in particular a centrifugal fan impeller 1, which is fixed, in particular pressed onto a rotor of an external rotor motor 2. The fan impeller 1 comprises a front cover plate 3 and a rear cover plate 4.

Figure 2:
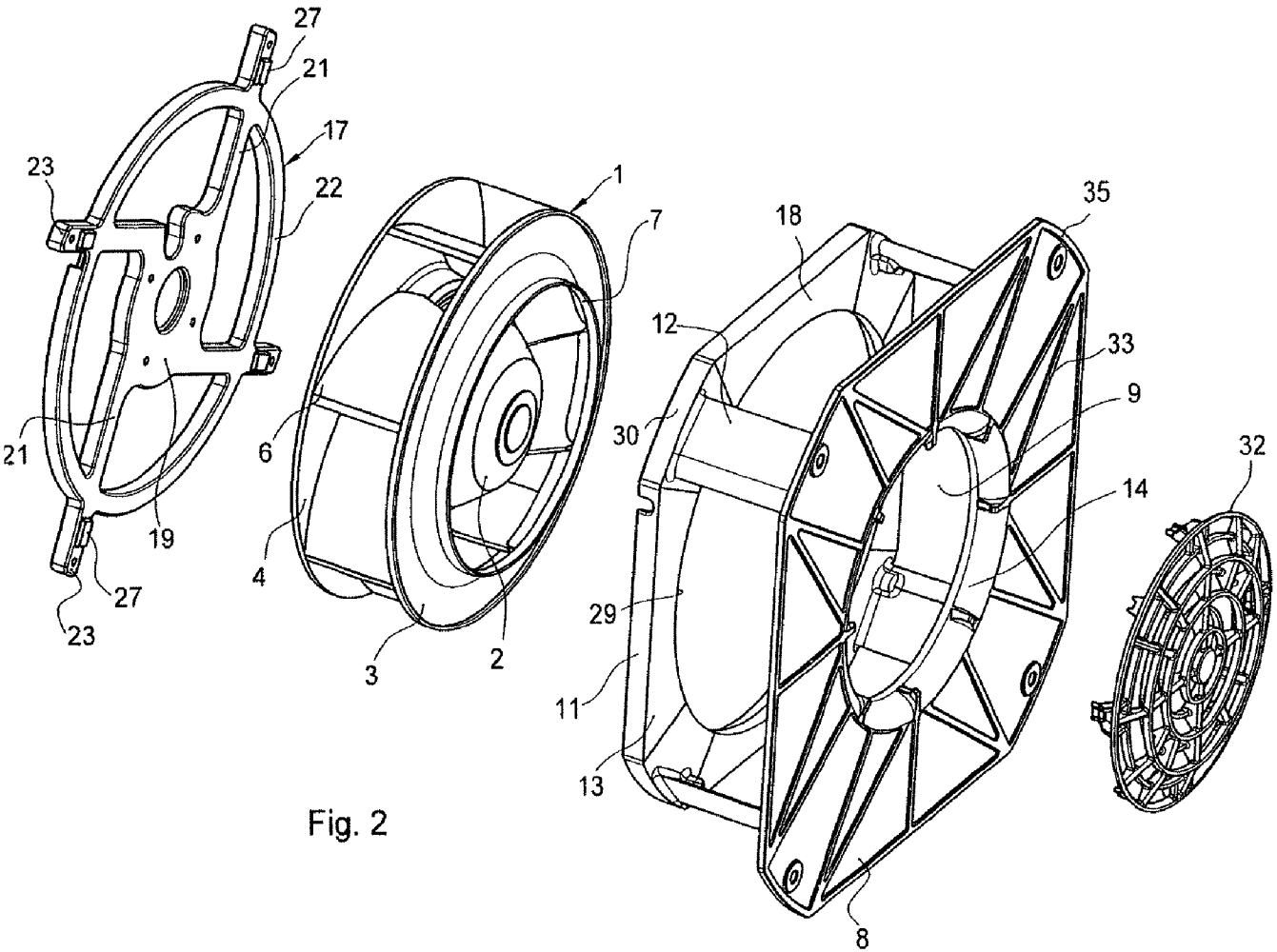
FIG. 2 shows a view of the compact fan according to FIG. 1 viewed in the direction II in FIG. 1.
Figure 3:
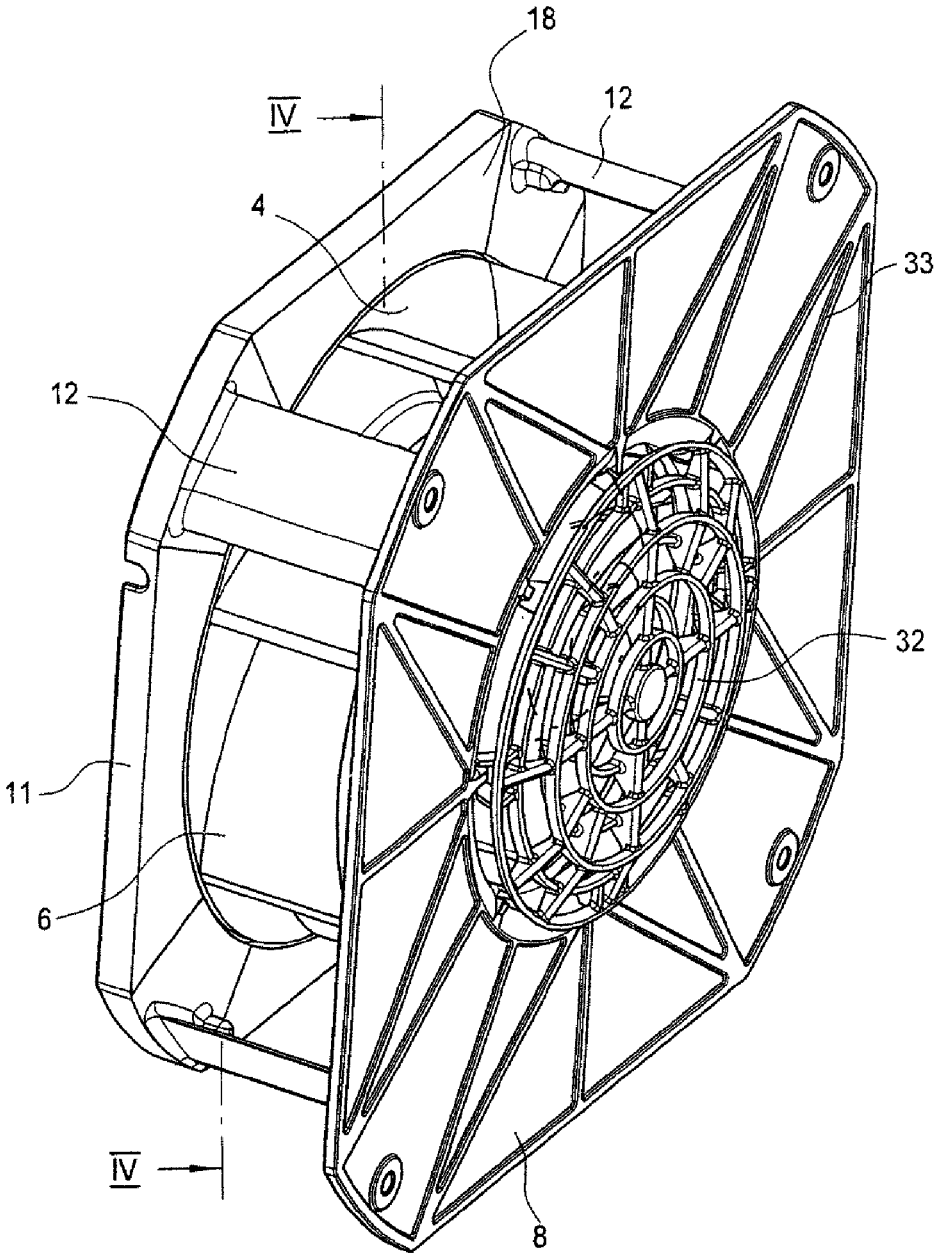
FIG. 3 shows a view of the compact fan according to FIG. 2 in the finally assembled state.

Backwardly curved blades 6 are arranged between these two cover plates 3 and 4. The front cover plate 3 has a circular air inlet opening 7, see FIG. 2. In the exemplary embodiment shown the external rotor motor 2 with the centrifugal fan impeller 1 is supported between a front plate 8 having an air inlet opening 9 and a motor mount 11, as shown in FIG. 3. The front plate 8 and the motor mount 11 are connected together by multiple spacers 12 arranged circumferentially on the circumference of the two parts 8 and 11. At the same time spacers 12 define the width of an air outlet gap 13 circumferentially formed around the centrifugal fan impeller 1. The front plate 8 and the motor mount 11 together with the spacers 12 are here embodied as an integral injection molded part composed of plastic or metal. The circular air inlet opening 9 has an inner rim area 14 formed as inlet flow orifice. In the assembled state this inlet flow orifice-like inner rim area 14 (inlet flow orifice) extends into the air inlet opening 7 of the front cover plate 3, so that its inside diameter is somewhat larger than the outside diameter of the inlet flow orifice 14.

Figure 1:
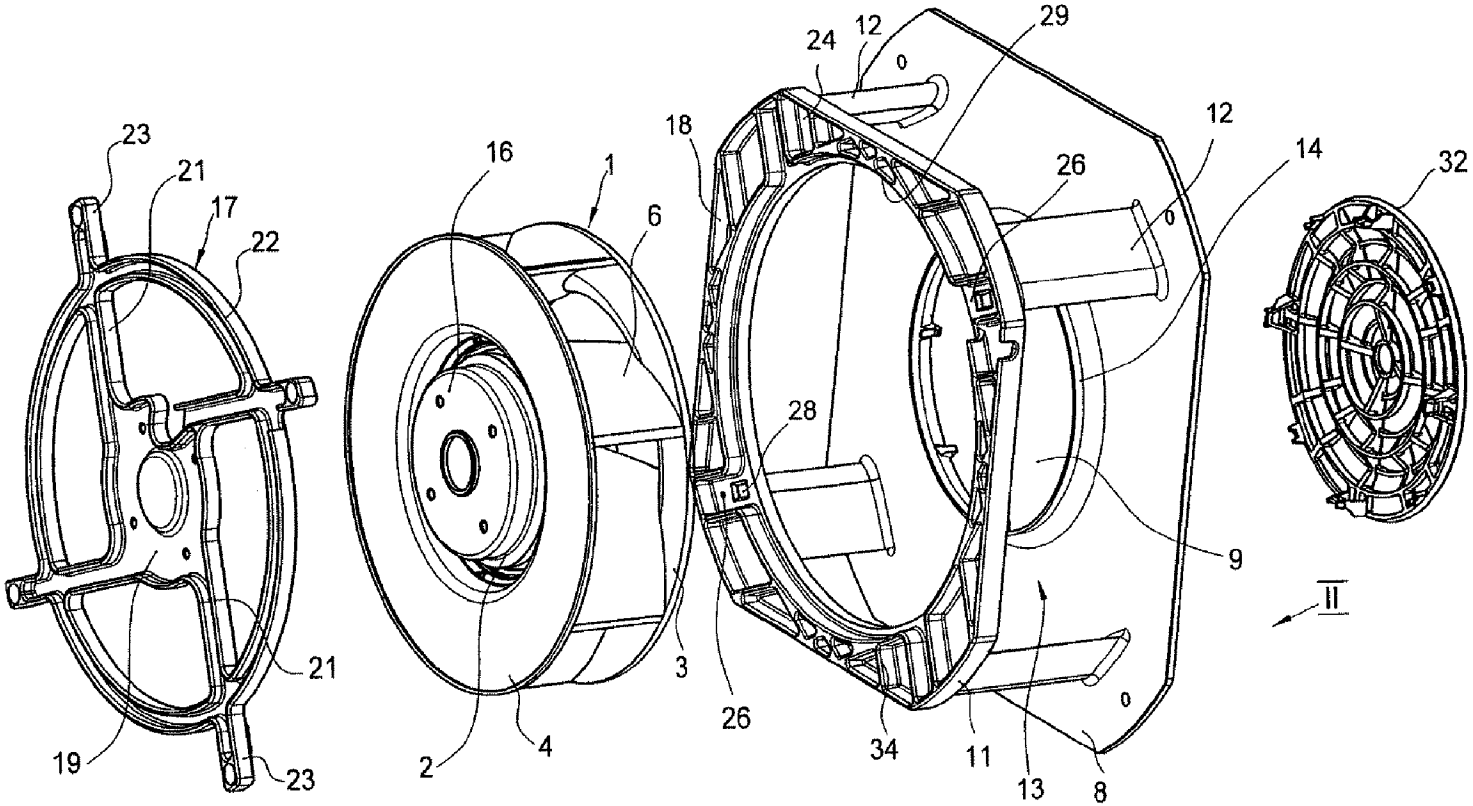
FIG. 1 shows an exploded view of a first embodiment of a compact fan according to the invention.

The external rotor motor 2 with its stator flange 16 is fixed by means of an intermediate mount 17 to the motor mount 11, that is to say to a circumferentially closed rim web 18 of the motor mount 11. The intermediate mount 17 has a central retaining plate 19, to which the motor flange 16 is fixed by means of screws, for example. Extending approximately radially outwards from the central retaining plate 19 are multiple spoke webs 21, which in the area of their free ends are connected by a circumferential annular web 22. The spoke webs 21 continue radially outwards with web extensions 23 beyond the annular web 22. In cross section the spoke webs 21 are formed as unilaterally open channels, that is to say they are of U-shaped cross section, which is useful for strength reasons and for saving material. At the same time one of the spoke webs 21 can thereby serve to accommodate a motor connection cable. The intermediate mount 17 can be manufactured as a plastic injection molded part or as a molded metal part, in particular as a metal casting. When formed as a molded metal part the intermediate mount 17 simultaneously serves as a heat conducting element. On its side 24 remote from the front plate 8 the motor mount 11 has mounting sockets 26, which with the intermediate mount 7 in the assembled state serve for mounting the web extensions 23 on the motor mount 11. In the exemplary embodiment shown four spoke webs 21 are formed on the central retaining plate 19, these spoke webs 21 each enclosing a right angle with their respective extensions. Here the spoke webs 21 do not run precisely radially, but are arranged so that in each case they run radially offset in relation to the central axis. Like the spoke webs 21 the annular web 22 of U-shaped cross section is also designed as a unilaterally open channel, again in order to save material and to increase the rigidity. The central retaining plate 19 also has a design accordingly adapted to the spoke webs 21. On their upper side the web extensions 23 have lugs 27, which with the intermediate mount 7 in the assembled state engage in matching depressions 28 (FIG. 1) in the mounting sockets 26 for positioning the parts in relation to one another. The intermediate mount 17 connected to the external rotor motor 2 is connected by screwed connections to the motor mount 11. For this purpose the external rotor motor 2 pre-assembled on the intermediate mount 17 with the centrifugal fan impeller 1 fastened to it is introduced into the intermediate space between the front plate 8 and the motor mount 11 through a circular mounting aperture 29 in the motor mount 11. For this purpose the diameter of the mounting aperture 29 is somewhat larger than the outside diameter of the centrifugal fan impeller 1. As shown in FIGS. 1 and 2, the spacers 12 are embodied as struts of approximately rectangular cross section having tapered corners, which run perpendicularly to the front plate 8 and to the rim web 18.

Figure 4:
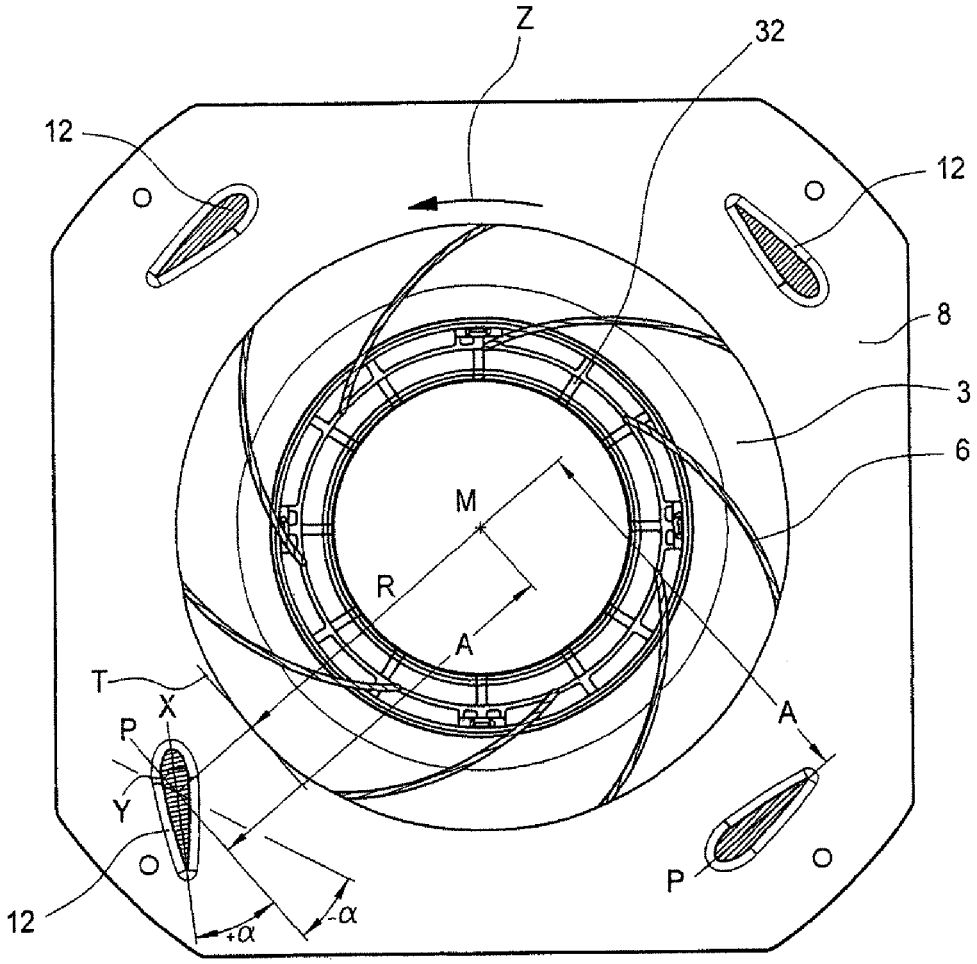
FIG. 4 shows a section along the line of section IV-IV in FIG. 3.

As emerges from FIG. 4, in particular, it is advantageous according to the invention if the web-shaped spacers 12 have the shape of streamlined profiles. These suitably take the form of vane profiles, which are aerodynamically and aero-acoustically optimized. Avoiding air flow separations or eddying on the spacer profiles consequently serves to preclude any negative effects on the air output and the noise caused by the spacers 12 themselves. As can be seen from FIG. 4, the streamlined spacers 12 have a longitudinal axis X and a transverse axis Y, the longitudinal axis X being longer than the transverse axis Y. The streamlined spacers 12 are at the same time arranged in such a way that they are oriented with their rounded front side opposed to the direction of rotation Z. For optimizing the flow properties of the spacers 12 it may be advisable for their longitudinal axis X to run at an acute angle of incidence $\alpha$ of preferably $-10° \leq \alpha \leq 60°$ to a tangent T, which is applied to the circular circumference of the centrifugal fan impeller 1, or to the straight line P running parallel to the tangent T. Another refinement according to the invention is to optimize the strut interval A of the struts from the center point or the central axis M of the centrifugal fan impeller 1, the strut interval A preferably being designed in such a way that: $1.05 \times R \leq A \leq 1.5$ R, where R is the radius of the centrifugal fan impeller 1.

As can further be seen from FIG. 1, the air inlet opening 9 in the front plate 8 may be closed by a protective grille 32. For this purpose the protective grille 32, which in particular is embodied as a plastic injection molded part, is latched to the front plate 8 by means of a clip connection. An integral formation with the front plate 8 is also possible, however. The front plate 8 is preferably dimensioned in such a way that it projects circumferentially beyond the motor mount 11 at its outer rim. The compact fan according to the invention can thereby be inserted so far through an insertion opening in a wall or a housing accommodating the compact fan until the front plate 8 bears against the wall accommodating the compact fan, thereby covering the insertion opening. The front plate 8 may serve for screw fastening of the compact fan according to the invention. The front plate 8 and the motor mount 11 are preferably square-shaped with each of the corners 30 and 35 being tapered.

Figure 5:
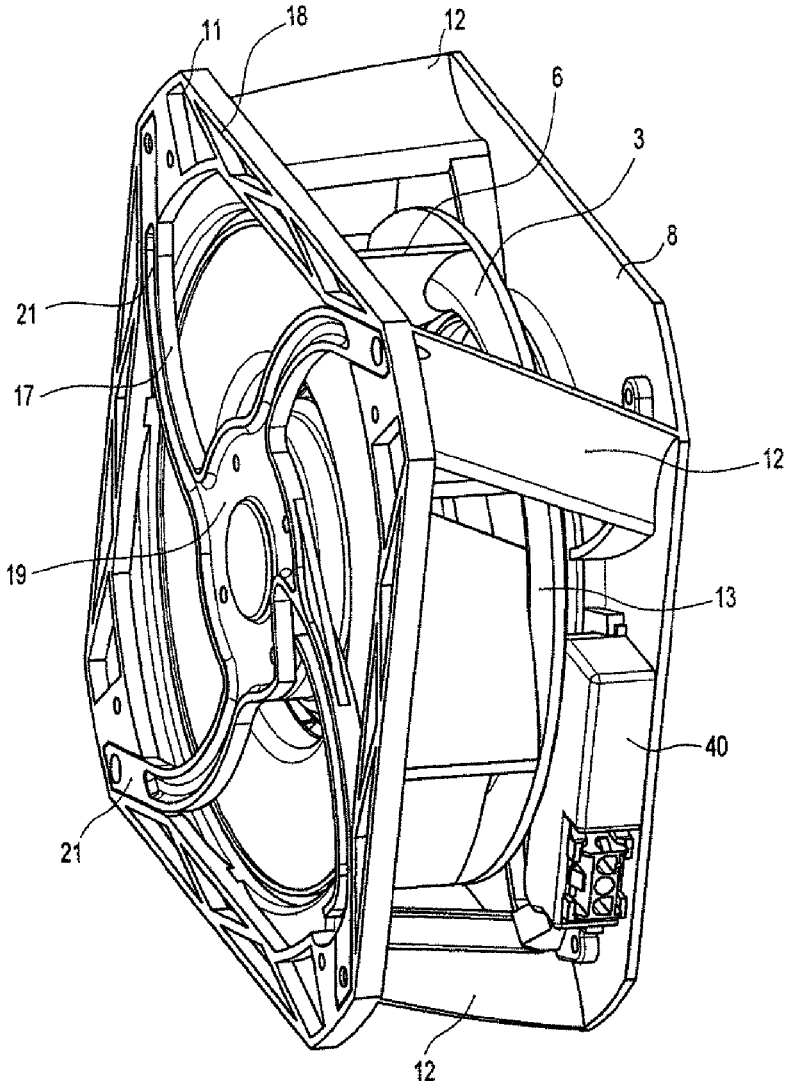
FIG. 5 shows a view of a further embodiment of a compact fan according to the invention.

FIG. 5 represents a compact fan according to the invention in an alternative embodiment to that shown in FIGS. 1 to 4. Here the intermediate mount comprises the central retaining plate 19 and spoke webs 21 formed on this. There are four spoke webs 21, which in this exemplary embodiment are of curved shape, uniformly distributed around the circumference. The spoke webs 21 can be connected directly to the rim web 18 of the motor mount 11, so that in this embodiment there is no annular web. In the exemplary embodiment shown the spacers 12 are embodied as streamlined struts of curved cross section. Here the curved shape is selected in such a way that the resulting curved struts have a convex contour facing towards the interior of the compact fan. The spacers 12 run obliquely to the front plate 8 and to the rim web 18 and they each originate and terminate in the corners 30 and 35. It can further be seen that a terminal box 40 is provided, partially in the intermediate space between the centrifugal fan impeller 1 and the front plate 8. Instead of a terminal box 40 for the electrical connection, just a single cable connection may also be provided.

Figure 6:
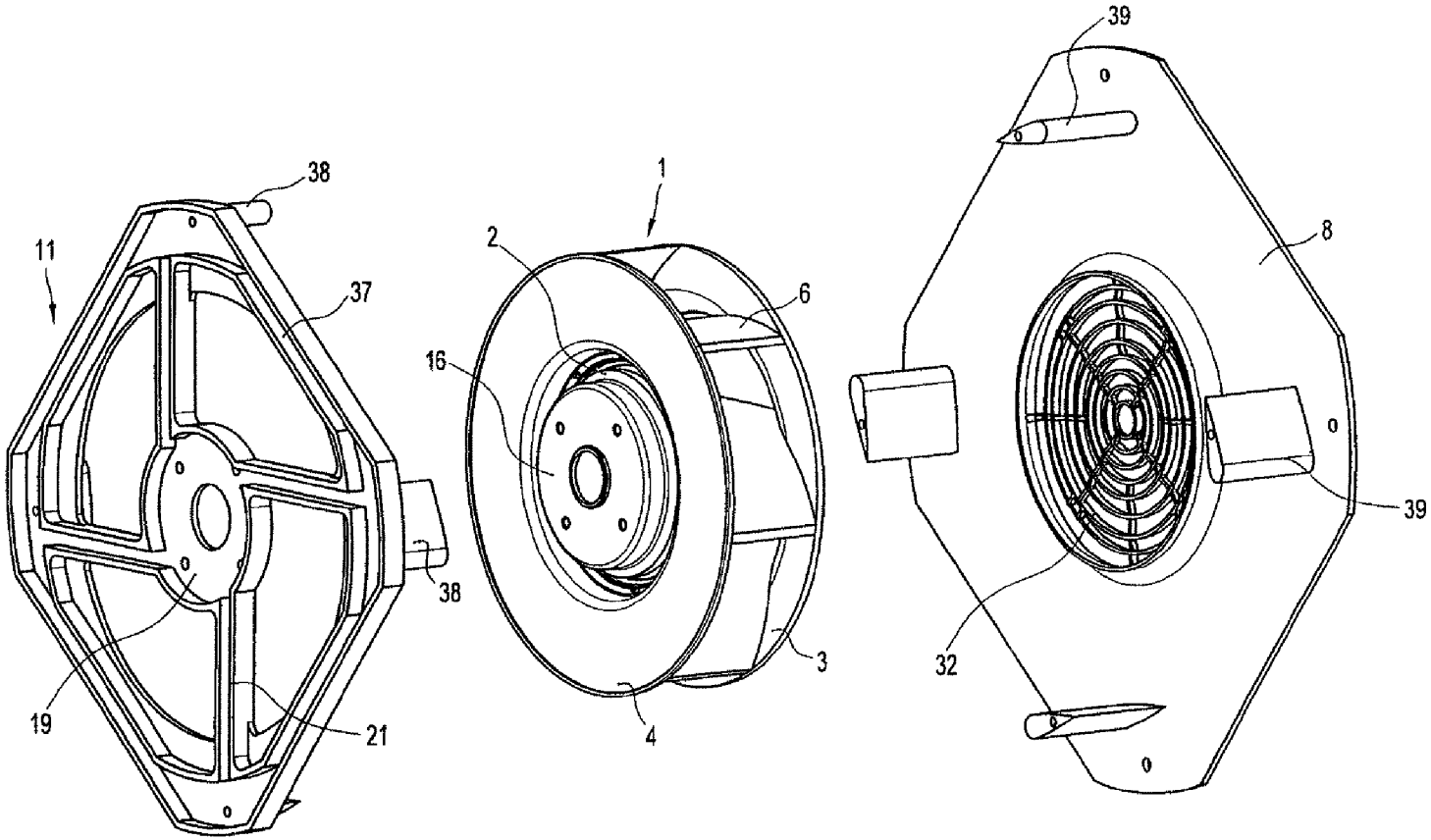
FIG. 6 shows an exploded view of a further embodiment of a compact fan according to the invention.
Figure 7:
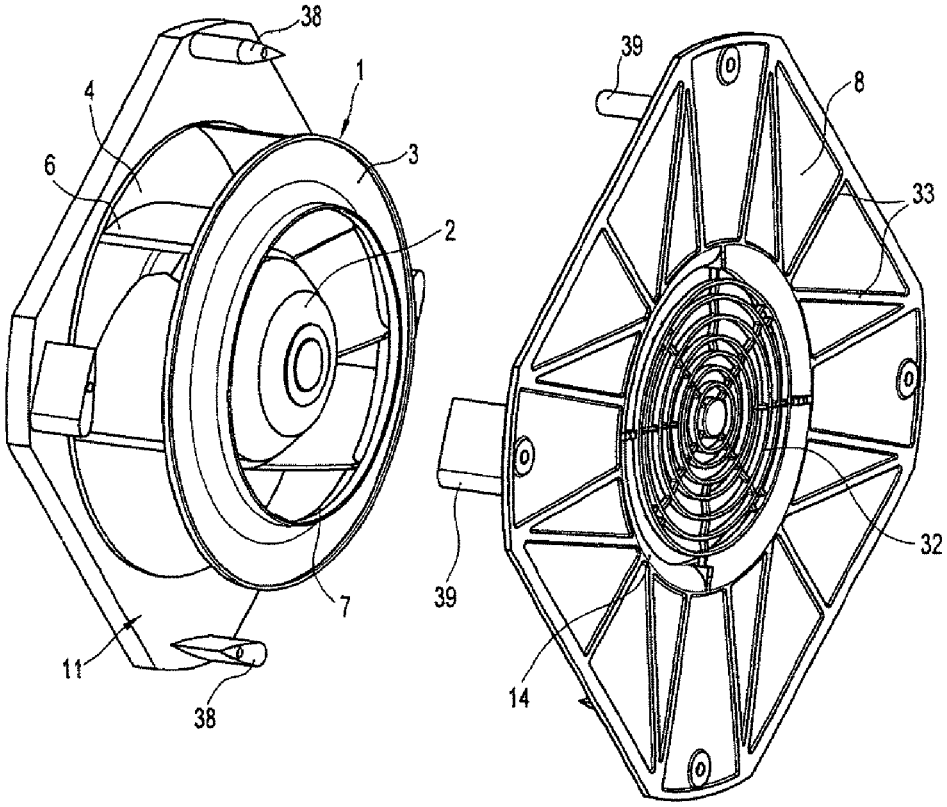
FIG. 7 shows a view of the compact fan according to FIG. 6 in a pre-assembly position.
Figure 8:
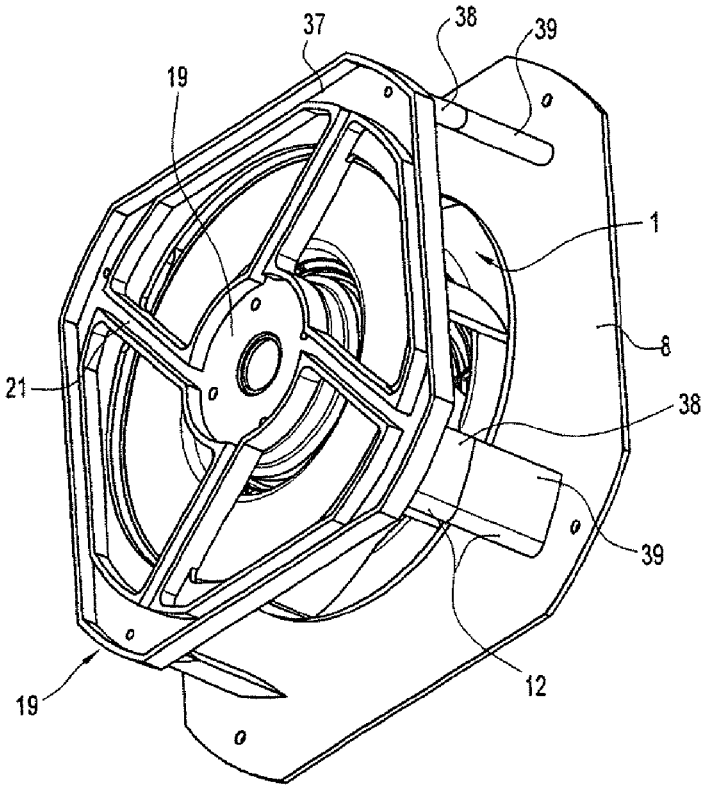
FIG. 8 shows a view of the finally assembled compact fan according to FIG. 6.

FIGS. 6 to 8 represent a further alternative embodiment of a compact fan according to the invention. In this embodiment the front plate 8, the motor mount 11 and the spacers 12 are formed from two injection molded plastic or metal parts that can be connected to one another in the area of the spacers 12. An intermediate mount as provided in the embodiments according to FIGS. 1 to 5 is therefore absent in this embodiment. The motor mount 11 comprises a central retaining plate 19 for fixing the stator flange 16 of an external rotor motor 2. Running outwards from this central retaining plate 19 are approximately radial spoke webs 21, which terminate in a circumferentially closed rim web 37. The rim web 37, the spoke webs 21 and the central retaining plate 19 consequently form the motor mount 11. In the exemplary embodiment shown both the front plate 8 and the motor mount 11 each comprise segments 38 and 39 of the spacers 12 on their mutually opposing sides. These segments 38 and 39 may be of equal or different length and without departing from the scope of the invention it is also possible for the spacers 12 to be formed in their entire length either on the front plate or on the motor mount 11. The compact fan according to the invention is here assembled in such a way that the centrifugal fan impeller 1 with the external rotor motor 2 is first screw-fastened on the motor mount 11, that is to say on the side of the motor mount 11 facing the front plate 8. The motor mount 11 is then connected to the front plate in the area of the abutting segments 38 and 39 of the spacers 12, for example by screwing fastening screws through the segments 39 and 39. This is preferably done from the rear side of the motor mount 11. The intermediate assembly position, in which the centrifugal fan impeller 1 is connected to the motor mount 11, is shown in FIG. 7. FIG. 8 shows the compact fan according to the invention in the completed state. In order to achieve a secure connection of the segments 38 and 39, it is advisable for these to be formed in such a way that they interlock at their butt joints. In the embodiment represented in FIGS. 6 to 8 the front plate 8 and the motor mount 11 are, in particular, produced as injection molded plastic parts. The protective grille 32 may be designed to clip on or it may also be integrally formed with the front plate 8. In this exemplary embodiment shown the front plate 8 and the motor mount 11, in particular its rim web 18, also have an approximately square peripheral contour, the corners of the square each being tapered. However, the invention is not limited to such a design of the front plate 8 and the motor mount 11. Both the front plate 8 and the motor mount 11 may be reinforced by rib structures 33 and 34, respectively.

The invention is not limited to the exemplary embodiments shown, but also encompasses all means exercising essentially similar effects within the scope of the invention While the above description constitutes the preferred embodiment of the present invention, it will be appreciated that the invention is susceptible to modification, variation, and change without departing from the proper scope and fair meaning of the accompanying claims.

The invention claimed is:

1. A compact fan, comprising a centrifugal fan impeller (1), which is fixed on a rotor of an external rotor motor (2) surrounding a stator, and which has a direction of rotation and is supported between a front plate (8) having a central air inlet opening (9), and a motor mount (11), and the front plate (8) and the motor mount (11) are connected together only by multiple, circumferentially arranged identical spacers (12), each of the spacers (12) having a streamlined, aerodynamic vane profile, the front plate (8) and the motor mount (11) are formed as injection molded plastic or metal parts, and the spacers (12) are formed as injection molded plastic or metal parts, each of the spacers (12) being divided into two parts (38, 39), a first part (39) of the two parts (38, 39) being integrally connected to the front plate (8) and a second part (38) of the two parts (38, 39) being integrally connected to the motor mount (11), the spacers (12) having a distance from each other defining a width of an unobstructed air outlet gap (13) and having a length defining a height of the unobstructed outlet gap, the stator (16) having a stator flange (16) fixed to the motor mount (11), wherein each of the first parts (39) interlocks with one of the second parts (38) at a butt joint, wherein the streamlined aerodynamic vane profile of the spacers (12) has a longitudinal axis (X) extending tangentially on a circular circumferential line of the centrifugal fan impeller (1), and wherein the streamlined, aerodynamic vane profile has two lateral faces opposite to one another across the direction of the longitudinal axis (X), a rounded front side opposed to the direction of rotation of the centrifugal fan impeller (1) the rounded front side adjoining each of the two lateral faces, and an angled rear side in the direction of rotation of the impeller, the angled rear side formed by the two lateral faces adjoining each other at the rear side, and the longitudinal axis extending from the rounded front side to the angled rear side.

2. The compact fan as claimed in claim 1, wherein the stator has a stator flange (16) fixed via an intermediate mount (17) to a circumferentially closed rim web (18) of the motor mount.

3. The compact fan as claimed in claim 2, wherein the intermediate mount (17) has a central retaining plate (19) for fixing the stator flange (16), from which plate multiple spoke webs (21), which in the area of their free ends are connected by a circumferential annular web (22) extending approximately radially outwards, the spoke webs (21) continuing radially outwards with web extensions (23) beyond the annular web (22).

4. The compact fan as claimed in claim 3, wherein the motor mount (11), on its side remote from the front plate (8), mounting sockets (26) for the ends of the spoke webs (21).

5. The compact fan as claimed in claim 3, wherein at least one of the spoke webs (21) of U-shaped cross section is formed as a unilaterally open channel.

6. The compact fan as claimed in claim 2, wherein the intermediate mount (17) is embodied as an injection molded plastic part or as a molded metal part.

7. The compact fan as claimed in claim 2, wherein the intermediate mount (17) is connected via screwed connections to the motor mount (11) in the area of the ends of the spoke webs (21) or the web extensions (23) and to the motor flange in the area of a central retaining plate (19).

8. The compact fan as claimed in claim 1, wherein the stator has a stator flange (16) and the motor mount (11) has a central retaining plate (19) for fixing the stator flange (16), projecting outwards from which plate are spoke webs (21) running approximately radially, which terminate in a circumferentially closed rim web (37).

9. The compact fan as claimed in claim 1, wherein the spacers (12) run perpendicularly or obliquely to the front plate (8) and the motor mount (11).

10. The compact fan as claimed in claim 9, wherein the spacers (12) have a transverse axis (Y) running perpendicularly to the longitudinal axis, the longitudinal axis (X) being longer than the transverse axis (Y).

11. The compact fan as claimed in claim 9, wherein a radial interval (A) of the spacers (12) from a central axis (M) of the centrifugal fan impeller (1) is selected as a function of the outer radius (R) of the centrifugal fan impeller (1) according to the rule of measurement $1.05\ R \leq A \leq 1.5\ R$.

12. The compact fan as claimed in claim 1, wherein the air inlet opening (9) in the front plate (8) is circular and has an inner rim area (14) formed as inlet flow orifice.

13. The compact fan as claimed in claim 1, wherein the air inlet opening (9) is closed by a protective grille (32) that can be fastened to or formed on the front plate (8).

14. The compact fan as claimed in claim 1, wherein the front plate (8) projects circumferentially beyond the motor mount (11) at its outer rim, and both parts (8, 11) have a square shape with tapered corners (30, 35).

15. The compact fan as claimed in claim 1, wherein the centrifugal fan impeller (1) comprises a front cover plate (3) and a rear cover plate (4), between which backwardly curved blades (6) are arranged, and the front cover plate (3) has a circular air inlet opening having a diameter which is larger than the outside diameter of the inlet flow orifice (14).

16. The compact fan as claimed in claim 1, wherein the centrifugal fan impeller (1) is pressed on to the rotor of the external rotor motor (2).

17. The compact fan as claimed in claim 1, wherein the front plate (8) and the motor mount (11) are reinforced by rib structures (33, 34).

* * * * *